United States Patent [19]

Caserta

[11] 4,221,099

[45] Sep. 9, 1980

[54] PROCESS FOR CONSTRUCTING BUILDINGS FOR USE AS DWELLINGS, OR FOR SOCIAL OR INDUSTRIAL USE

[75] Inventor: Umberto Caserta, Treviso, Italy

[73] Assignee: SKAUT Prefabbricati S.r.1., Treviso, Italy

[21] Appl. No.: 884,542

[22] Filed: Mar. 8, 1978

[30] Foreign Application Priority Data

Mar. 18, 1977 [IT] Italy ..... 3373 A/77

[51] Int. Cl.[2] ..... E04B 1/348

[52] U.S. Cl. ..... 52/745; 52/79.11

[58] Field of Search ..... 52/79.7, 79.8, 79.11, 52/79.1, 79.2, 79.3, 79.4, 79.5, 79.6, 79.9, 79.12, 79.13, 79.14, 745

[56] References Cited

U.S. PATENT DOCUMENTS

| | | | |
|---|---|---|---|
| 3,488,900 | 1/1970 | Reid | 52/79.7 |

FOREIGN PATENT DOCUMENTS

| | | | |
|---|---|---|---|
| 722341 | 11/1965 | Canada | 52/79.1 |
| 2342047 | 2/1974 | Fed. Rep. of Germany | 52/79.7 |
| 2513067 | 2/1975 | Fed. Rep. of Germany | 52/79.11 |
| 2543508 | 10/1976 | Fed. Rep. of Germany | 52/79.14 |
| 1264580 | 5/1961 | France | 52/79.11 |
| 2289686 | 5/1976 | France | 52/79.11 |
| 1194372 | 6/1970 | United Kingdom | 52/79.1 |
| 1271024 | 4/1972 | United Kingdom | 52/79.7 |
| 1443233 | 7/1976 | United Kingdom | 52/79.11 |

*Primary Examiner*—John E. Murtagh

*Attorney, Agent, or Firm*—Browdy and Neimark

[57] ABSTRACT

Disclosed herein is a process for constructing buildings for use as dwellings, or for social or industrial use, which utilize, either partially or completely, prefabricated units dimensioned to render them easily transportable, which can be joined together in such a way as to create one-storied and multi-storied structures of various known designs, that are bound stably to one another in order to create buildings that extend upwards in height over a considerable number of stories and have anti-seismic characteristics of a high standard.

The said units are constituted by a U-shaped, three dimensional base unit and by a complementary, three dimensional, angle shaped unit, these being provided with vertical walls or pillars which, over their full height, have an open space utilized for vertically binding with concrete, the said units one to the other and to the foundations.

5 Claims, 14 Drawing Figures

A
1
5
5'
6
2
7
A
A 5
5'
5'
4
3
5
2

C
14
12
11
13

B
9
8
10
21
10
10
15
17
16
2

B
B'
A
C

B
B'
A

B
A

A

C
B
B'
A
C

C'
B
B'
C''
A
C

19
D

C'
A'
A'
D
D'
20
A
A
C

PROCESS FOR CONSTRUCTING BUILDINGS FOR USE AS DWELLINGS, OR FOR SOCIAL OR INDUSTRIAL USE

This invention relates to a process for constructing buildings for use as dwellings, or for social or industrial use, and a building constructed in accordance with the said process using, partially or totally, prefabricated units.

Various processes or systems are known for the prefabrication of buildings, and the most widely adopted method is what is known as "heavy prefabrication", which is a system that makes use of prevalently artificial stone building materials, such as cement mix and bricks, the construction being carried out essentially in specialist facilities, in the form of walls and/or flooring.

The said walls and flooring include reinforcing parts, ducts for electricity, water and heating equipment, insulation and door and window frames etcetera.

The said units or prebricated components are subsequently transported from the factory to the erection sites where they are inter-assembled and thus become support structures that are obviously very heavy and to put the together calls for a considerable labor force at the site, and this, in consequence, affects the total cost of the complete building very noticeably.

Attempts have been made to overcome the foregoing by resorting to prefabricated, three dimensional, modular units of standardized dimensions and shapes, which can be inter-assembled in accordance with more or less predetermined schemes in such a way as to give rise to one-storied compositions: the superposing of these units one on top of the other, generally repeating the scheme adopted for the first storey, results in multi-storied buildings of predetermined basic structure being constructed, which, depending on the degree of expertise used to prefabricate the said modular units, can even be in their structurally final form.

One difficulty encountered with the above method is that the modular units constituting the base units, both when superposed one on top of the other to construct multi-storied buildings and when positioned with other complementary units, are generally "dry bound" or are joined together with solutions which although matching, are, nevertheless, outside the original modular unit project, the purpose of this being to dispense with casting operations in order to construct the said buildings more rapidly, and whilst this, in one way, offers a certain financial advantage, in another, it prevents buildings of over a certain number of stories from being constructed and it prevents well defined anti-seismic characteristics.

An essential object of the present invention is, therefore, to overcome the aforementioned difficulties by making available a process for constructing buildings, utilizing prefabricated modular units sized in such a way as to render them easily transportable, which can be inter-assembled so as to create one-stored or multi-storied structures, variable to suit the various known types and, above all, able to be firmly bound together in order to make possible the construction of buildings having a considerable number of stories and excellent anti-seismic characteristics.

These and other objects have been attained with the process forming the subject of the present invention, an essential feature of which is that it comprises the following:

(a) The in situ preparation of the foundations and, eventually, of the staircase groups;

(b) The erection of at least one, essentially U-shaped, three dimensional, prefabricated base support modular unit of standardized dimensions, positioned so that at least the extremities of the base rest on the foundations provided, the vertical walls of the said base unit each being constituted by at least two pillars placed close to the base vertices, each pillar being provided over its full length with an open space that also extends over the full thickness of the base;

(c) The erection of one or more, essentially angle shaped, three dimensional, prefabricated complementary modular units, positioned so as to rest with the base on the relevant foundations, with the free end of the base resting on the base of the said support unit or on the staircase group or else on the base of another complementary unit;

(d) The construction of a structure for vertically connecting the various base support units stably by pouring cement mix into the inside of the open spaces in the aforementioned pillars;

(e) The fitting of the roof and the creation of additional intersection points for stably fastening the said roofing to the vertical walls of the said modular units.

A description of the foregoing will be given hereinafter with reference to the accompanying drawings wherein a preferred, but not the sole, form of embodiment for constructing buildings in accordance with the process described herein is illustrated.

More ample details of the said drawings are now given hereunder:

FIG. 1A shows a front elevational view and

FIG. 1B shows a plan view of the modular base unit used in the construction of buildings in accordance with the process forming the subject of the present invention;

FIG. 2A shows a front elevational view and 2B shows a plan view of a first complementary modular unit used in the construction of buildings in accordance with the present invention;

FIG. 3A shows a front elevational view,

FIG. 3B shows a plan view, and FIG. 3C shows a side elevational view of another complementary modular unit used in the construction of buildings in accorance with the present invention;

FIG. 14A shows a front elevational view and FIG. 14B shows a plan view of complementary bi-dimensional modular unit used in the construction of buildings in accordance with the present invention.

Figures 1, 2, 3, 12:
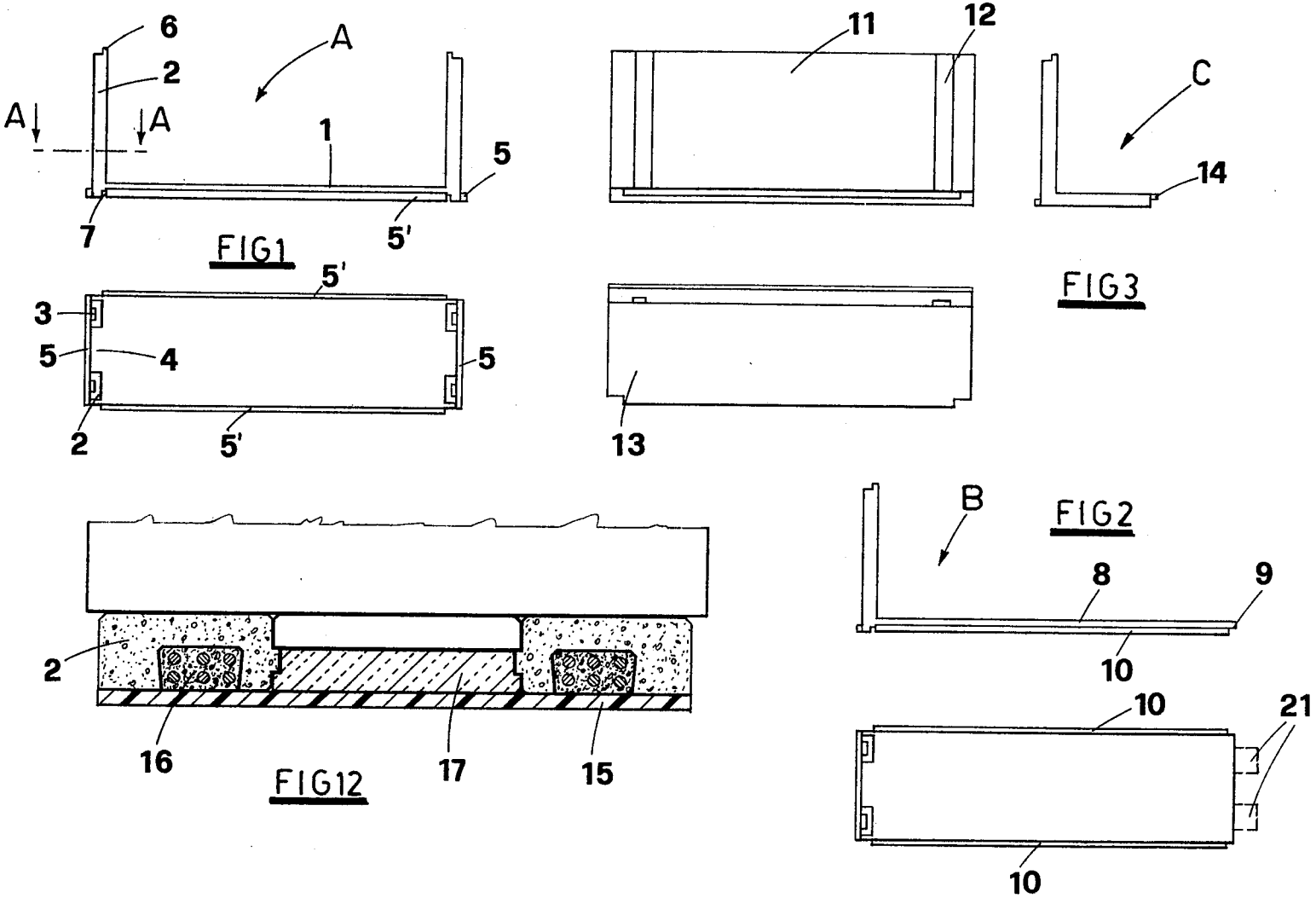
FIG. 12 shows, in a sectional view, along the lines A—A in FIG. 1, the wall of the modular base unit in one probable example of a completed building.

With reference to the above mentioned figures, an essentially U-shaped, three dimensional, prefabricated base support unit in one of the multiple standardized sizes used in the process for the construction of buildings described herein is depicted in FIGs. 1A and 1B with its base (1) extended in the form of a rectangle. The said dimensions are, in all cases, such as to allow the units to be easily transported from the prefabrication facility to the erection site.

The vertical walls of the said base support are normally each constituted by two vertical pillars (2) positioned in the region of the base vertices and these, over their full height, are provided with an open space (3) that also extends over the full thickness of the base (1). The said open space communicates directly with the outside as can clearly be seen in FIG. 1 and in FIG. 12, the latter being a section along the line A—A in FIG. 1. Naturally, the open space in the said pillars can also be turned to point inwards.

Between the said two pillars there is a utilizable area (4) which, as will be seen later on, can be used for window frames; alternatively, the said area can be blocked in with brickwork or with prefabricated units. To suit particular exigencies, the vertical wall of the said base support can obviously be unbroken.

The base of the said unit (A) is provided peripherally with a tongue (5) and 5'), the function of which will become more apparent in the due course. Likewise, at the top of the said pillars (2) there is a projection (6) which fits into a complementary housing (7) located in the base (1) when superposing the said base support units (A) one on top of the other in order to create multi-storied buildings. The said pillars are produced in dimensions which render statically stable structures possible when the said units are simply superposed one on top of the other.

In FIGS. 2A and 2B a complementary, three dimensional, angle shaped modular unit (B) is shown and this has a rectangular base (8) extending at a right angle to the vertical wall. Apart from the fact that the angle shaped modular unit (B) has one vertical wall less than the base unit (A), the characteristics of the former are identical to those of the latter. On the free end of the base (8) there is a tongue (9), complementary to the corresponding tongue (5) on the unit (A), and along the longitudinal sides of the base (8) there is a tongue (10) which is identical to the tongue (5') on the unit (A). When the unit concerned is used to rest on other units, the upper tongue (9), for example, has to be used, whilst when it has to support other units, it is necessary to use the lower tongue (5') or (10). FIGS. 3A–3C show a complementary, three dimensional, angle shaped modular unit (C), with one vertical wall (11) provided, in the region of its extremities, with one or more open spaces (12) (identical to those on the pillars of the units (A) and (B)) which also extend through the full thickness of the base (13). The free end of the latter is provided with a tongue (14) identical to the tongue (9) on the unit (B). The vertical wall of the said complementary unit (C) can obviously be constituted by two or more pillars identical to those to be found in the aforementioned units (A) and (B).

The widths of the bases of the units (A), (B) and (C) are all the same and are either equal to or are multiples of a predetermined modular value. The length of the base of the unit (A) is an exact multiple of the said modular value; that of the base of the unit (C) is at least equal to the length of the base of the unit (A) or of the unit (B). The height of the vertical walls, or of the pillars, are all the same and correspond to the height of one storey of the building to be constructed.

Now, with the aid of FIGS. 4–9, a diagrammatic example of how a building is constructed can be seen. First of all, a base support unit (A) (FIG. 4) is positioned on the foundations previously prepared at the site, and the base of the said support unit is twice the length of the predetermined modular value which corresponds to the width of the base. A first unit (B) (FIG. 5) is rested on a lateral tongue (5') on the said base support unit (A) and then a second unit (B') (FIG. 6) is placed at the side of the first unit, both with their base resting on foundations provided for this purpose.

In the same way, on the other side of the unit (A) and resting thereon, a unit (C) (FIG. 7) is positioned and then subsequently, to complete one particular way of constructing the building, two units (C') and (C'') are placed at the side of the two units (B) and (B') (see FIGS. 8 and 9).

At this juncture, after having repeated the same sequence of operations for each additional storey, superposing the same (or sometimes even different) units one on top of the other and then, after putting on the roof, a reinforced cement mix is poured into the inside of at least the pillars in the unit (A) and, when there are any particular anti-seismic requirements, into the inside of all the pillars and open spaces provided for this purpose since this firmly binds the support units to one another and to the other units, and all the units globally to the foundations, thereby creating in this way a structure with a frame particularly suitable for withstanding static and dynamic stress of a certain intensity.

Subsequently the structure is given its inside and outside finish: prefabricated sealing panels (15) (FIG. 12) with an external finish are placed on the outside front of the building to hide the castings (16) and the non particularly finished surfaces of the pillars or vertical walls; inside partition walls can be erected (prior to the roofing operation when prefabricated units are used), insulating material (17) is then used to seal the spaces in between the two pillars and the internal finishing panels are placed in position.

Window and door frames can be placed both in the space available between two units and in the space available between the two pillars in one and the same unit.

Figure 10:
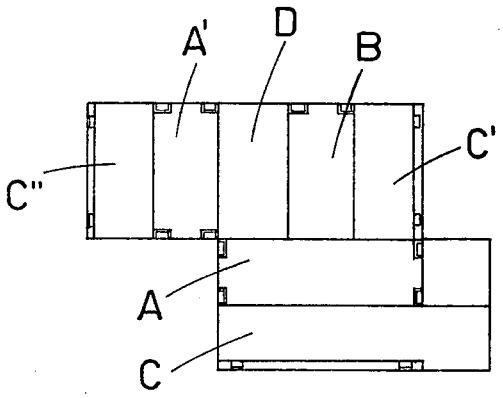
FIGS. 10 and 11 show, diagrammatically in plan view form, other building construction examples.

In FIG. 10 another construction example is given, and this utilizes two units (A) and (A'), respectively, these having a base of different lengths converging into an arris. In this case a bi-dimensional unit (D) is used, this also being prefabricated, of standardized dimensions proportional to the predetermined modular value. This is provided along its two longer sides with support tongues (19) (FIGS. 14A and 14B) designed to support and secure the said units (D) to the base of the adjoining units.

Figure 11:
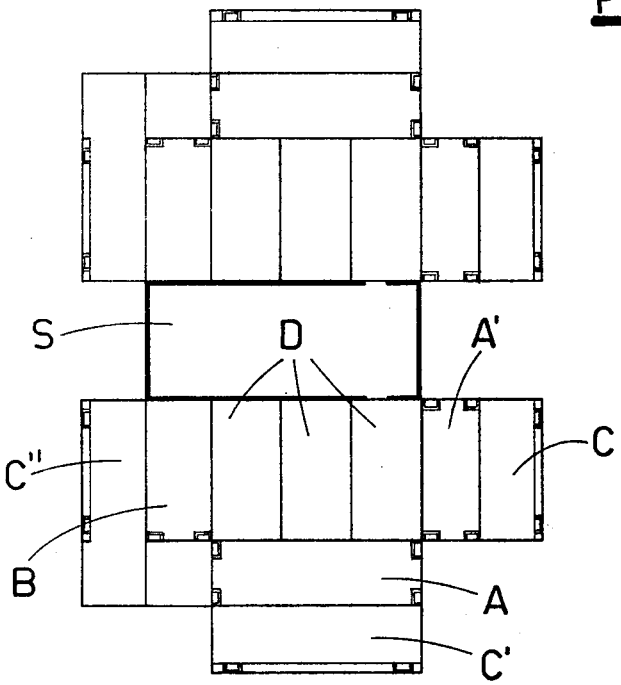

FIG. 11 show another building construction example in which at (S) there is a staircase group, preferably a prefabricated unit, onto which rest (via the customary tongues) the units (B), thereby creating, together with the units (D) and other units, a construction that has a considerable extension.

Figures 4, 5, 6, 7, 8, 9, 13, 14:
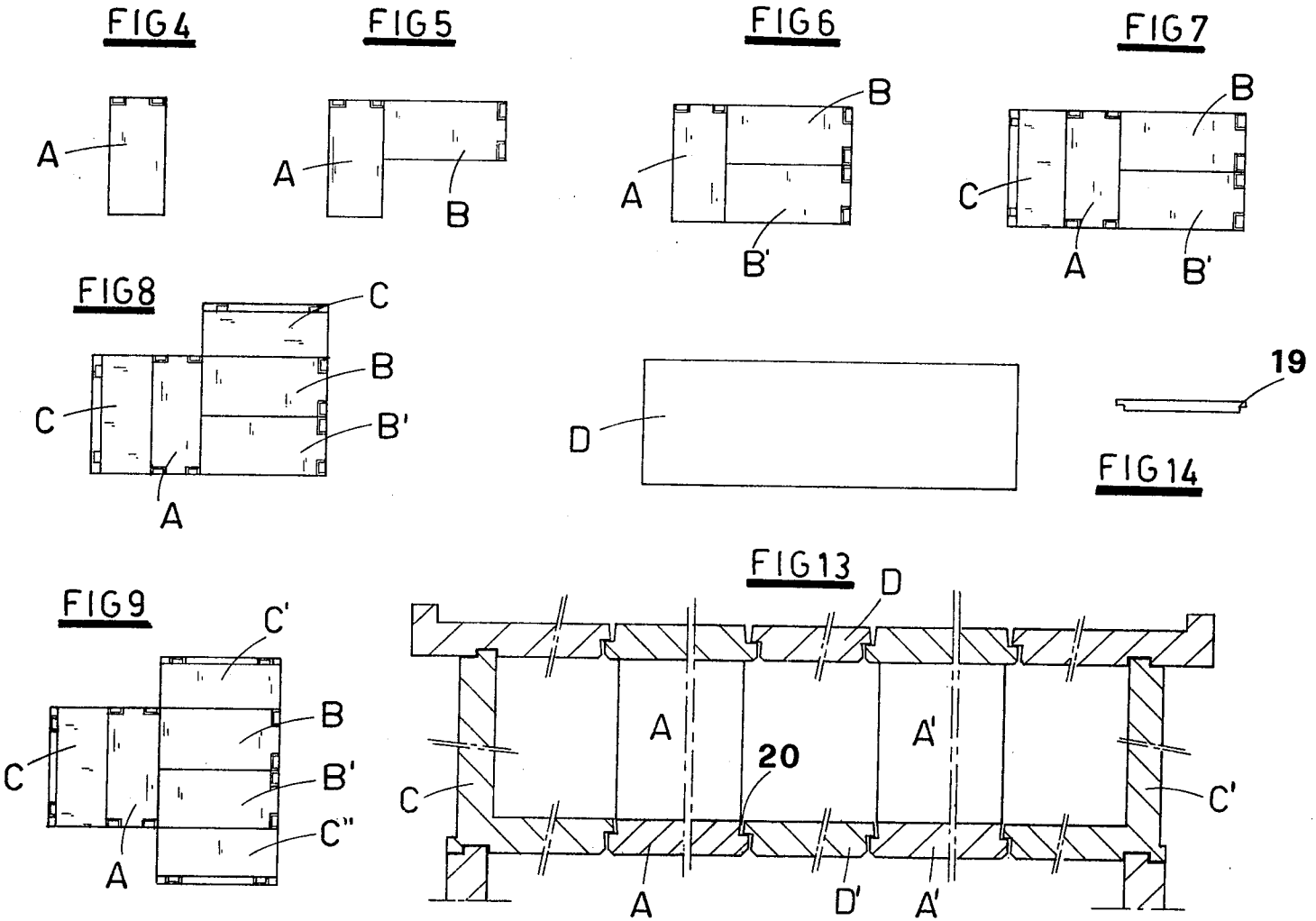
FIGS. 4, 5, 6, 7, 8 and 9 show, diagrammatically in plan view form, the succession of stages in the construction of one example of a building.
FIG. 13 shows in a diagrammatic sectional view, one example of the composition and superposing of modular units for construction a buliding in accordance with the process forming the subject of the present invention.

Finally, in FIG. 13 an example is given of the various units utilized for the process forming the subject of the present invention, wherein details can be seen of how the various units are united and superposed. The spaces left between one unit and another when placed together are shown at (20) and are utilized for the various plants.

An interesting variation for the unit (B) can be the use of two steel stirrups (21) at points corresponding to the free end of the base, these fitting into complementary housings in the pillars of a base support unit (A) in such a way as to create, following the placing of a unit ((B) longitudinally with respect to one of the said units (A), a tightly bound structure once concrete has been poured into the inside of the said pillars since this naturally also affects the said stirrups (21). This is most important because it is possible in this way to create ample, stable, support structures that constitute the nucleus of the resulting building.

Thus it has been made possible to construct buildings using stable support towers (the superposing of units (A) or of units (A)+(B), as seen above) which are prepared ready to accept other units and are able to withstand the notable stress multi-storied buildings suffer.

The vertical connection system makes it a particularly suitable one to be used in seismic areas where precise connections typical of frame systems are necessary.

It should be borne in mind that the aforementioned details concerning the units that go to make up the process forming the subject of the present invention are to be considered purely unlimited examples.

What is claimed is:

1. A process for the production of a building of more than one storey using prefabricated, transportable, U-shaped, tridimensional load-bearing elements, and prefabricated, transportable, essentially angle-shaped, tridimensional complementary elements, each of said load bearing elements comprising a rectangular base and two vertical walls, one at each of the two short sides of the base, each wall being constituted at least by two pillars placed closed to the base vertices, each pillar being provided over the entire length thereof with an open channel extending also through the full thickness of the base, and each of said complementary elements having a rectangular base and, at only one side thereof, a vertical wall constituted at least by two pillars, the process comprising the steps of:

preparing foundations in situ;

positioning at least one of said prefabricated load-bearing elements so that at least the extremities of the base thereof rest on the foundations;

positioning at least one of said complementary elements on said foundations such that the base of said complementary element at the end opposite the vertical wall thereof rests on the base of one of said load-bearing elements;

for each additional storey of the building, positioning one of said load-bearing elements directly above each of said load-bearing elements of the first storey such that the channels in the pillars thereof interconnect, and positioning one of said complementary elements on each said complementary element of the storey below such that the base of each said complementary element of each storey, at the end opposite the vertical wall thereof, rests on the base of one of said load-bearing elements of the same storey;

pouring cement into the inside of the channels in said pillars, thereby binding said support elements vertically to one another; and fitting a roof to the vertical walls of the uppermost storey.

2. A process in accordance with claim 1, further including the steps of:

after said step of positioning said complementary element on said foundations, positioning at least one further complementary element on said foundations such that the base of said complementary element at the end opposite the vertical wall thereof rests on the base of one of said complementary elements which are in turn resting on the base of one of said load bearing elements; and for each additional storey of the building, after the step of positioning said complementary element of each additional storey, positioning at least one further complementary element on each said further complementary element of the storey below, such that the base of each said further complementary element of each storey, at the end opposite the vertical wall thereof, rests on the base of one of said complementary elements of the same storey which is in turn resting on the base of one of said load bearing elements of the same storey.

3. A process in accordance with claim 1 wherein said complementary elements have at least two configurations including at least one first unit wherein said vertical wall is at one of the short sides thereof, and at least one second unit wherein said vertical wall is at one of the long sides thereof; and wherein the vertical walls of each of said load bearing elements and said complementary elements have the same height and the rectangular base of each of said load bearing elements and said complementary elements have the same width and a length which is an integral multiple of said width.

4. A process in accordance with claim 1 wherein the bases of each of the elements include support means for supporting or being supported by complementary support means on adjacent bases.

5. A process in accordance with claim 4 wherein the support means comprise overlapping tongues.

* * * * *